US010501949B2

(12) United States Patent
Weaver

(10) Patent No.: US 10,501,949 B2
(45) Date of Patent: Dec. 10, 2019

(54) CONCRETE PIER FOUNDATION ANCHOR BOLT SUPPORT AND CHAMFER FORM

(71) Applicant: Everett David Weaver, Tulsa, OK (US)

(72) Inventor: Everett David Weaver, Tulsa, OK (US)

( * ) Notice: Subject to any disclaimer, the term of this patent is extended or adjusted under 35 U.S.C. 154(b) by 181 days.

(21) Appl. No.: 15/420,460

(22) Filed: Jan. 31, 2017

(65) Prior Publication Data

US 2017/0138071 A1 May 18, 2017

Related U.S. Application Data

(63) Continuation-in-part of application No. 14/197,496, filed on Mar. 5, 2014, now Pat. No. 9,556,627.

(60) Provisional application No. 61/773,086, filed on Mar. 5, 2013.

(51) Int. Cl.

| | |
|---|---|
| ***E04G 13/02*** | (2006.01) |
| ***E04B 1/41*** | (2006.01) |
| ***E04G 21/18*** | (2006.01) |
| ***E04G 17/00*** | (2006.01) |
| *E04B 1/21* | (2006.01) |

(52) U.S. Cl.

CPC ..... *E04G 13/021* (2013.01); *E04B 1/4157* (2013.01); *E04G 17/004* (2013.01); *E04G 21/185* (2013.01); *E04B 1/21* (2013.01); *E04B 2103/02* (2013.01)

(58) Field of Classification Search

CPC ... E04G 13/021; E04G 17/004; E04G 21/185; E04G 13/023; E04G 13/04; E04G 13/028; E04B 1/4157; E04B 1/21; E04B 2103/02; E04B 1/4121; Y10S 425/803; Y10S 269/904; B28B 21/76; B28B 23/005; B28B 23/0056; B28B 7/0014; B28B 7/0017; B28B 7/002; B28B 7/0032; E02D 27/42; E02D 27/32; F03D 13/20; Y10T 292/694

USPC ..... 425/803; 249/98–101, 25, 95; 52/761, 52/651.01, 651.02, 726.4, FOR. 116, 52/FOR. 117, FOR. 118, FOR. 119; 33/562, 563, 566, 613, 645, 518, 526; D10/64; 292/340, 341.17, 341.18, 292/341.15; 403/DIG. 1; 285/9.1

See application file for complete search history.

(56) References Cited

U.S. PATENT DOCUMENTS 3,219,308 A * 11/1965 Halstead ..... E02D 27/00 249/205
3,897,288 A * 7/1975 Fayling ..... B23Q 3/1546 156/289
4,261,544 A * 4/1981 Addison ..... B28B 23/005 249/207

(Continued)

*Primary Examiner* — Leith S Shafi
(74) *Attorney, Agent, or Firm* — Martin S. High, P.C.

(57) ABSTRACT

Embodiments of the Concrete Form include a form tube, chamfer disk, and one or more cross-members. The cross-members are comprised of a center pivot aperture, two bolt guides, which are formed by the cross-members, end clamps, and an optional clamp. The chamfer disk is a disk that sits atop of the form tube and forms side chamfers in positive relief when placed upon the form tube when the concrete cures. The optional conduit clamp can be used to hold any conduit, tube or any other item during the pour. In another embodiment of the Concrete Form is comprised of a form tube, chamfer disk, end clamps, four or more bottom slide arms, and four or more top slide arms.

7 Claims, 13 Drawing Sheets

(56) References Cited

U.S. PATENT DOCUMENTS

| | | | | |
|---|---|---|---|---|
| 2008/0006761 | A1* | 1/2008 | Vitale | B28B 7/0085 249/57 |
| 2012/0184385 | A1* | 7/2012 | Davis | A63J 1/02 472/77 |
| 2013/0207305 | A1* | 8/2013 | Moore | E04C 5/168 264/262 |

* cited by examiner

CONCRETE PIER FOUNDATION ANCHOR BOLT SUPPORT AND CHAMFER FORM

CROSS-REFERENCE TO RELATED APPLICATIONS

This application is a continuation-in-part of pending application Ser. No. 14/197,496 filed on Mar. 5, 2014 and claims benefit of application Ser. No. 14/197,496. Application Ser. No. 14/197,496 in turn claims benefit of U.S. Provisional Application No. 61/773,086, filed on Mar. 5, 2013. U.S. Non-Provisional patent application Ser. No. 14/197,496 and U.S. Provisional Patent Application No. 61/773,086 are incorporated by reference in its entirety for all purposes as if fully set forth herein.

STATEMENT REGARDING FEDERALLY SPONSORED RESEARCH OR DEVELOPMENT

Not applicable

FIELD OF THE EMBODIMENTS

The field of the embodiments of the Concrete Form is concrete forms used to contain concrete during the curing process of the concrete.

BACKGROUND OF THE EMBODIMENTS

The background of the embodiments of the Concrete Form is the broad use of concrete forms. When forming a support pylon for objects including lamp posts, signs, and structural piers, it is common to use concrete form tubes to contain the concrete while it is curing. Usually the form is a simple, water-resistant tube that the concrete is poured into and allowed to contain the concrete during cure. This simple form does not permit finer finishing of the concrete including the formation of a chamfer on the outer edges of the concrete.

SUMMARY OF THE EMBODIMENTS

In summary, the embodiments of the Concrete Form are comprised of a form tube, one or more cross-members, a chamfer disk, one or more end clamps, and one or more optional conduit clamps. The cross-members are comprised of a center pivot aperture, one or more bolt guides, which are formed by the cross-members. The chamfer in the concrete is formed by the chamfer disk which is placed on top of the concrete form tube. The chamfer disk is a separate formed/molded piece that will sit on top of the tube form in order to form a chamfer in the concrete. The optional conduit clamp can be used to hold any conduit, tube or any other item during the pour. The anchor bolt holder will have two cross-members with two bolt guides per arm. This will give a total of four locations that an anchor bolt can be installed. The cross-members are manufactured from a metal, metal alloy, or a polymeric material and are between ⅛ inch to ½ inch in thickness. In another embodiment, the cross-members can be thicker towards the end of the cross-members (the ends that rest on the circumference of the form) relative to the middle of the cross-members to provide the necessary support for the Concrete Form when in practice. In another embodiment of the Concrete Form is comprised of a form tube, chamfer disk, end clamps, four or more bottom slide arms, and four or more top slide arms.

In this respect, it is to be understood that the embodiments in this application are not limited to the details of construction and to the arrangements of the components set forth in the description or illustrated in the drawings. The embodiments are capable of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the embodiments described in this application. Additional benefits and advantages of the present embodiments will become apparent in those skilled in the art to which the embodiments relate from the description of the preferred embodiment and the appended claims, taken in conjunction with the accompanying drawings. It is important, therefore, that the claims be regarded as including such equivalent constructions insofar as they do not depart from the spirit and scope of the embodiments described herein.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the embodiments of the application, which is measured by the claims, nor is it intended to be limiting as to the scope of the embodiments in any way.

DETAILED DESCRIPTION OF THE PREFERRED EMBODIMENTS

Figure 1:
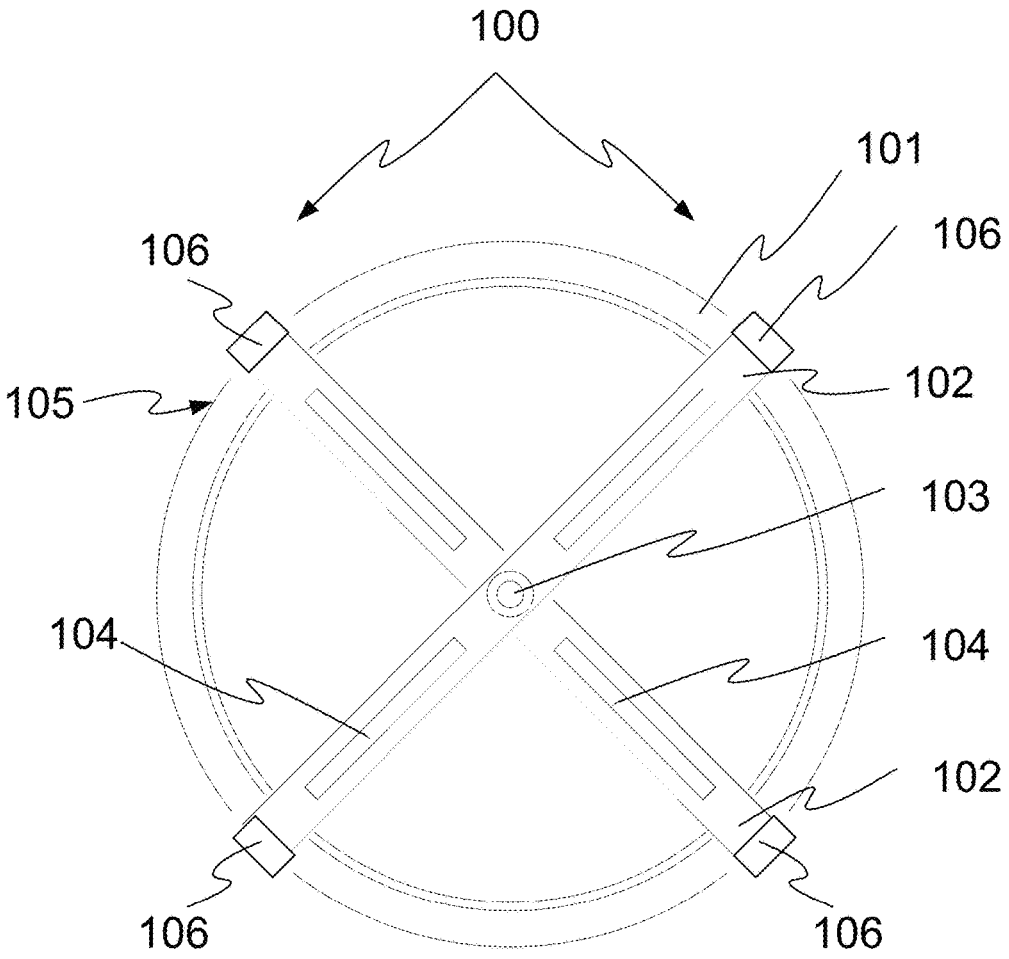
FIG. 1 is a top view of an embodiment of the Concrete Form.
Figure 2:
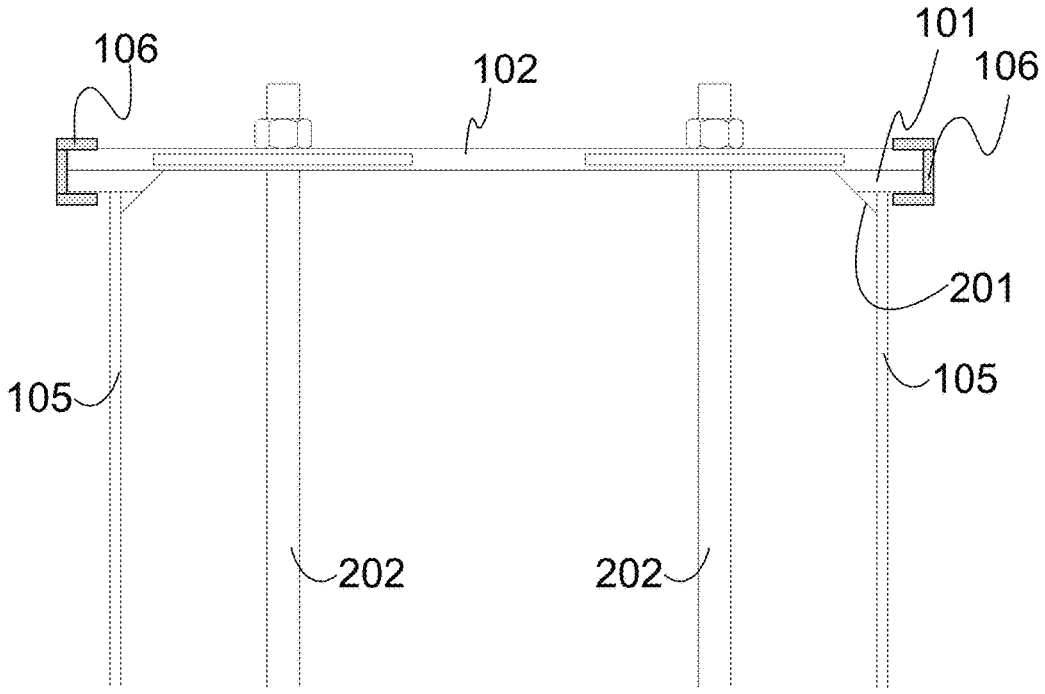
FIG. 2 is a side view of an embodiment of the Concrete Form.
Figure 3:
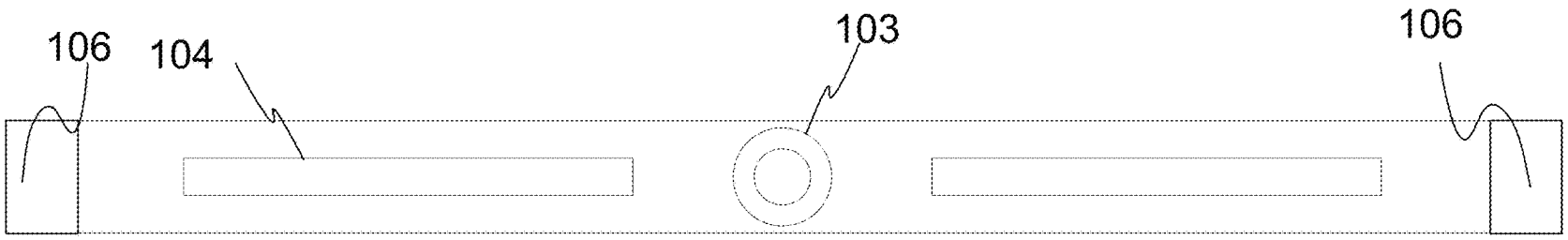
FIG. 3 is a top view of an embodiment of the cross cross-member of the Concrete Form.
Figure 4:
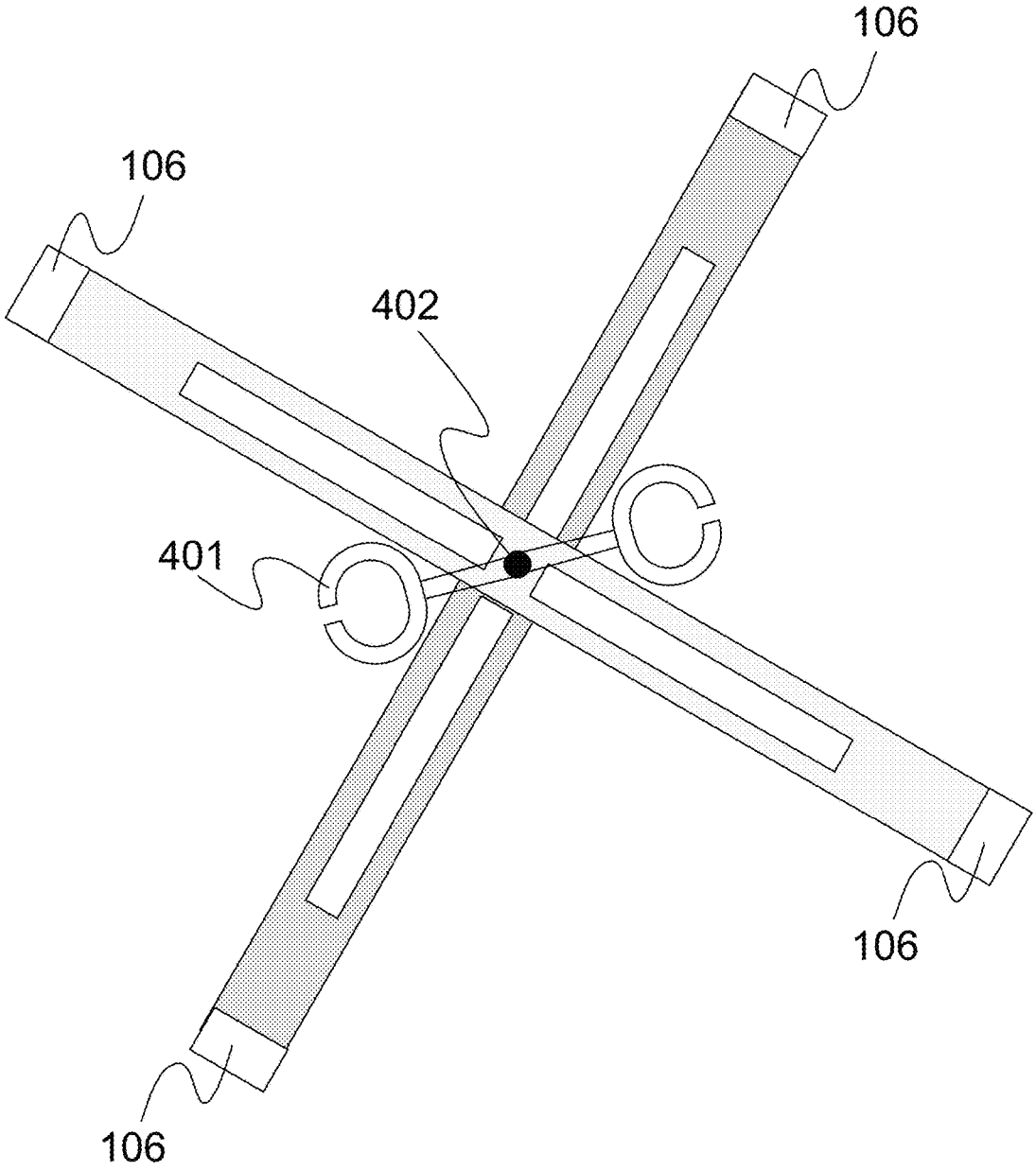
FIG. 4 is a top view of an embodiment of the Concrete form with two cross cross-members and a conduit support attached to the cross-members.
Figure 5:
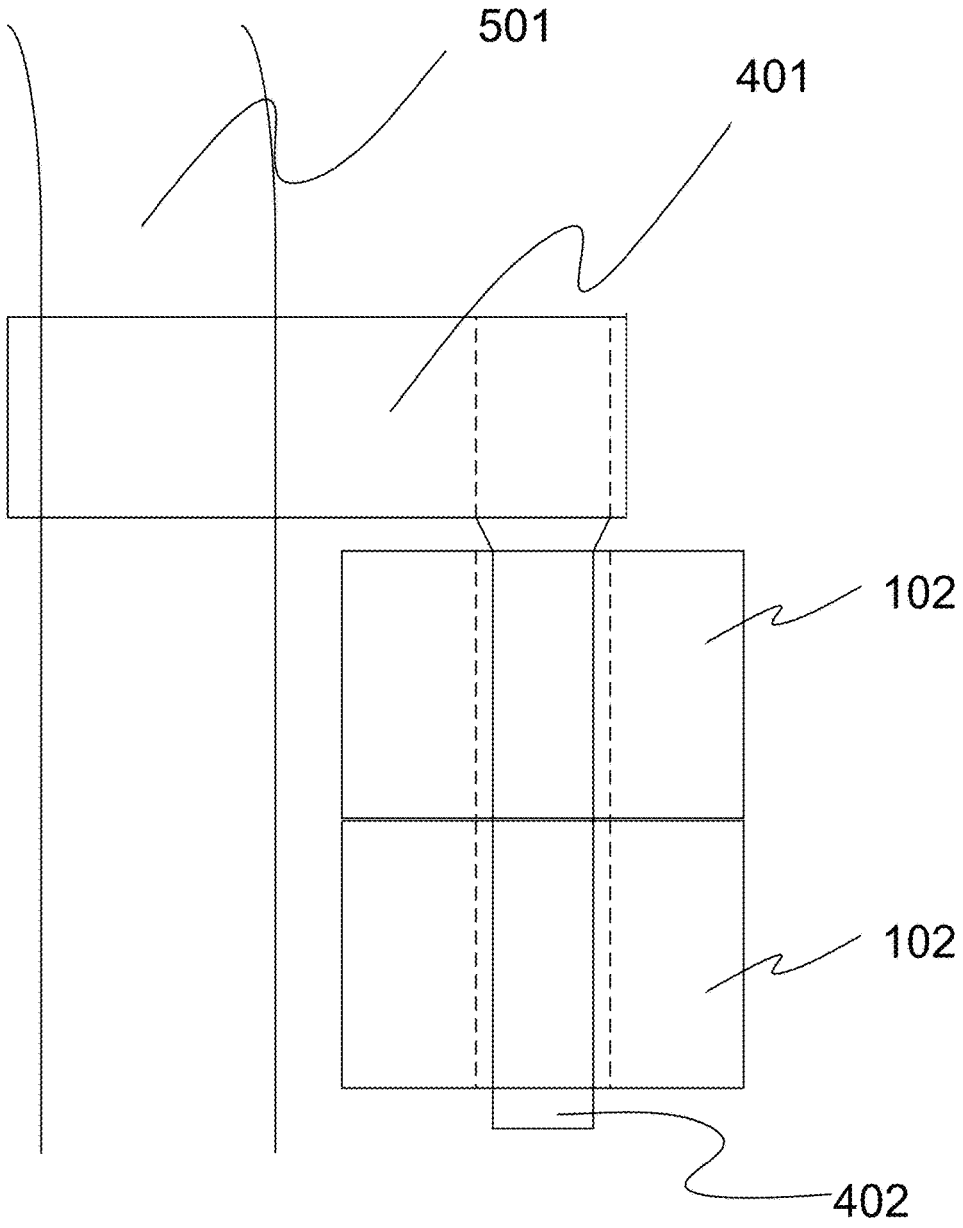
FIG. 5 is a schematic view of an embodiment of the Concrete Form showing how the stacking pivot points are used to secure the conduit clamps that in turn secures a conduit.

Embodiments of the Concrete Form 100 include a form tube 105, chamfer disk 101, end clamp 106, and one or more cross-members 102.

The cross-members 102 are each comprised of a center pivot aperture 103, two bolt guides 104 formed by the cross-members 102, and an optional conduit clamp 401. The conduit clamp 401 is secured to one or more cross-members via a center pivot pin 402 that passes through the center pivot aperture 103. The cross-members 102 are manufactured from metal, metal alloy, or a polymeric material and are between ⅛ inch to ½ inch in thickness and approximately 2 inches wide. In one embodiment of the Concrete Form 100, the cross-members 102 can be thicker towards the end of the cross-members 102 (the ends that rest on the circumference of the form) relative to the middle of the cross-members 102 to provide the necessary support for the Concrete Form 100 when in practice.

The chamfer disk 101 is placed on top of the form tube 105 when in use. The chamfer disk 101 is a ring-shaped device with the chamfer (blunt 201 or curved 1101) formed in positive relief under the ring of the chamfer disk 101. The chamfer disk 101 forms chamfers 201 that when placed upon the form tube 105, causes chamfers to be formed in the concrete when it is poured. The chamfer disk 101 allows the user to produce uniform chamfers 201 on the side of the concrete. The user pours the concrete into the form and fills the form to the chamfer disk 101. Once the concrete hardens sufficiently, the user can remove the chamfer disk exposing the formed chamfer 201 on the concrete.

Figure 6B:
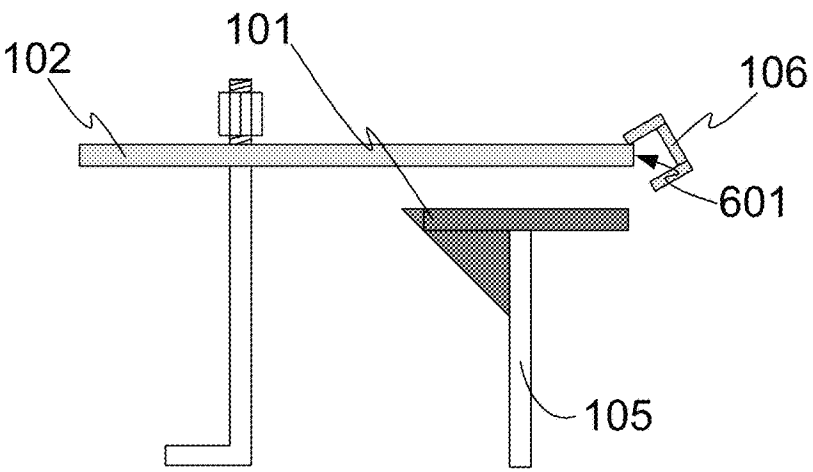
FIG. 6B is a side view of an embodiment of the Concrete Form showing how the end of the cross-member distal from the first end clamp forms a cross-member end to secure the cross-member to the form tube.
Figure 6A:
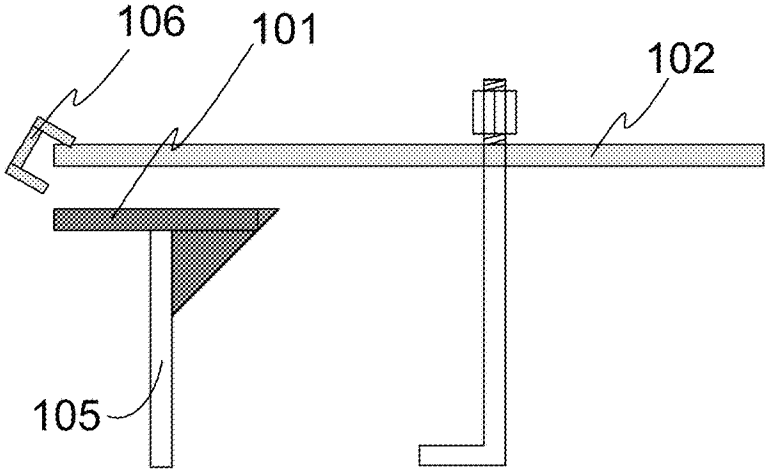
FIG. 6A is a side view of an embodiment of the Concrete Form showing how the first end of the cross-member forms a cross-member end to secure the cross-member to the form tube.
Figure 7B:
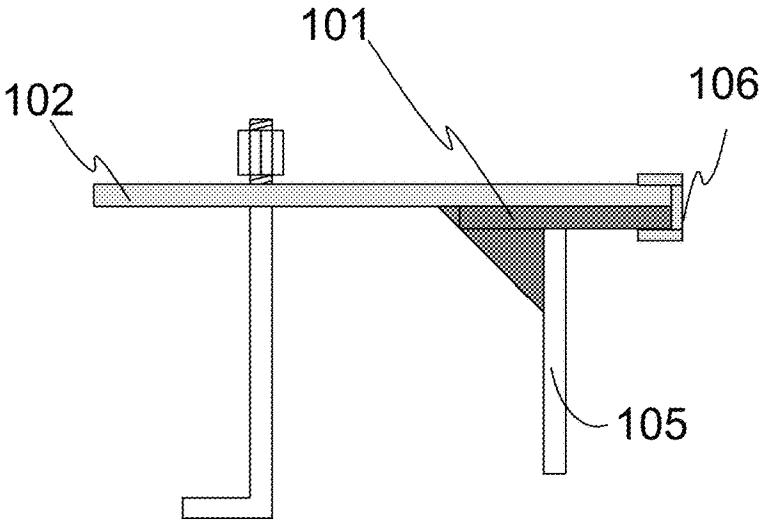
FIG. 7B is a side view of an embodiment of the Concrete Form showing the end clamp distal to the first end is engaged to secure a cross-member to the chamfer disc.
Figure 7A:
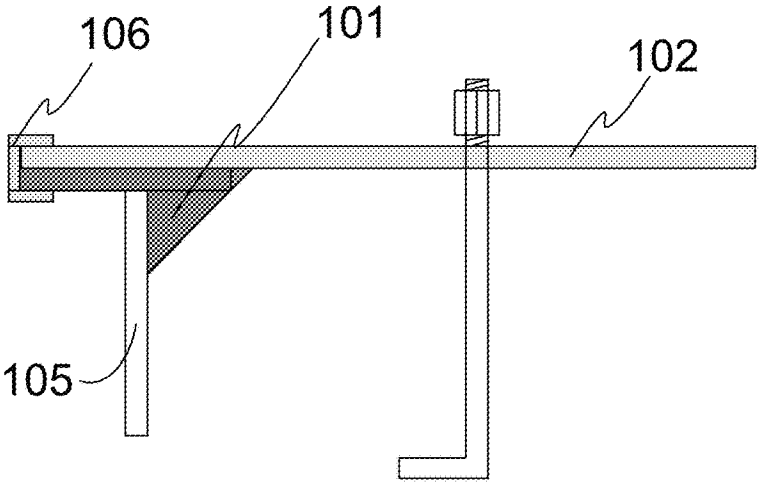
FIG. 7A is a side view of an embodiment of the Concrete Form showing the end clamp on the first end is engaged to secure a cross-member to the chamfer disc.
Figure 8A:
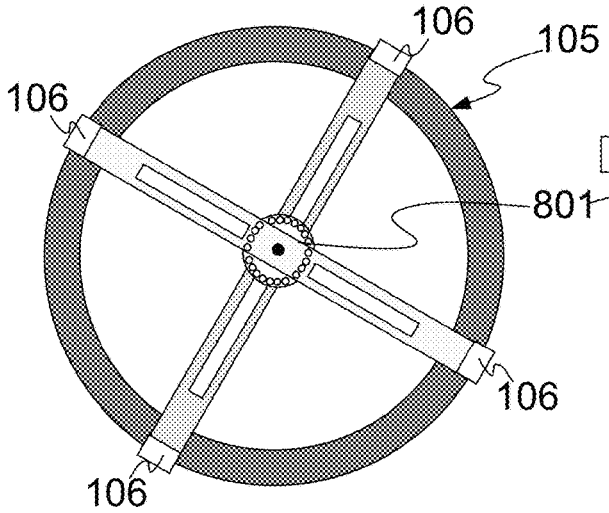
FIG. 8A is a top view of an embodiment of the Concrete Form showing the end clamps engaged to secure a cross-member to the chamfer disc and a pin hole disk cross-member 801.
Figure 8C:
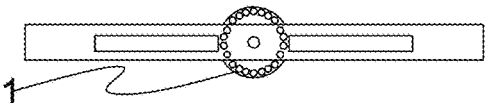
FIG. 8C is a top view of an embodiment of the cross-member of the Concrete Form.
Figure 8B:
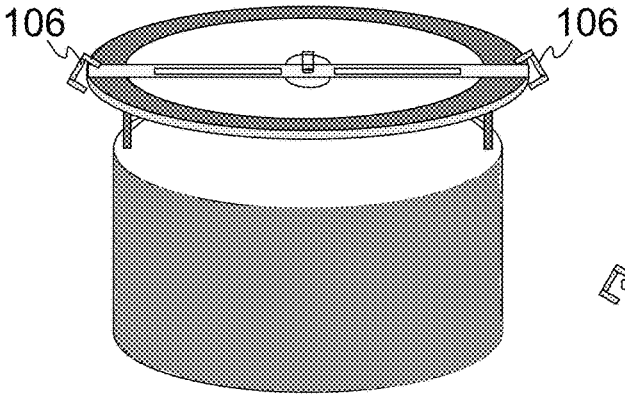
FIG. 8B is a perspective view of an embodiment of the Concrete Form showing a pin hole disk cross-member.
Figure 8D:
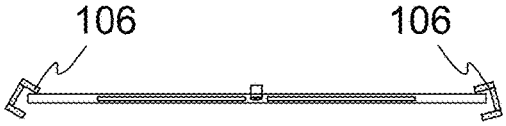
FIG. 8D is a side view of an embodiment of the cross-member of the Concrete Form.
Figure 9:
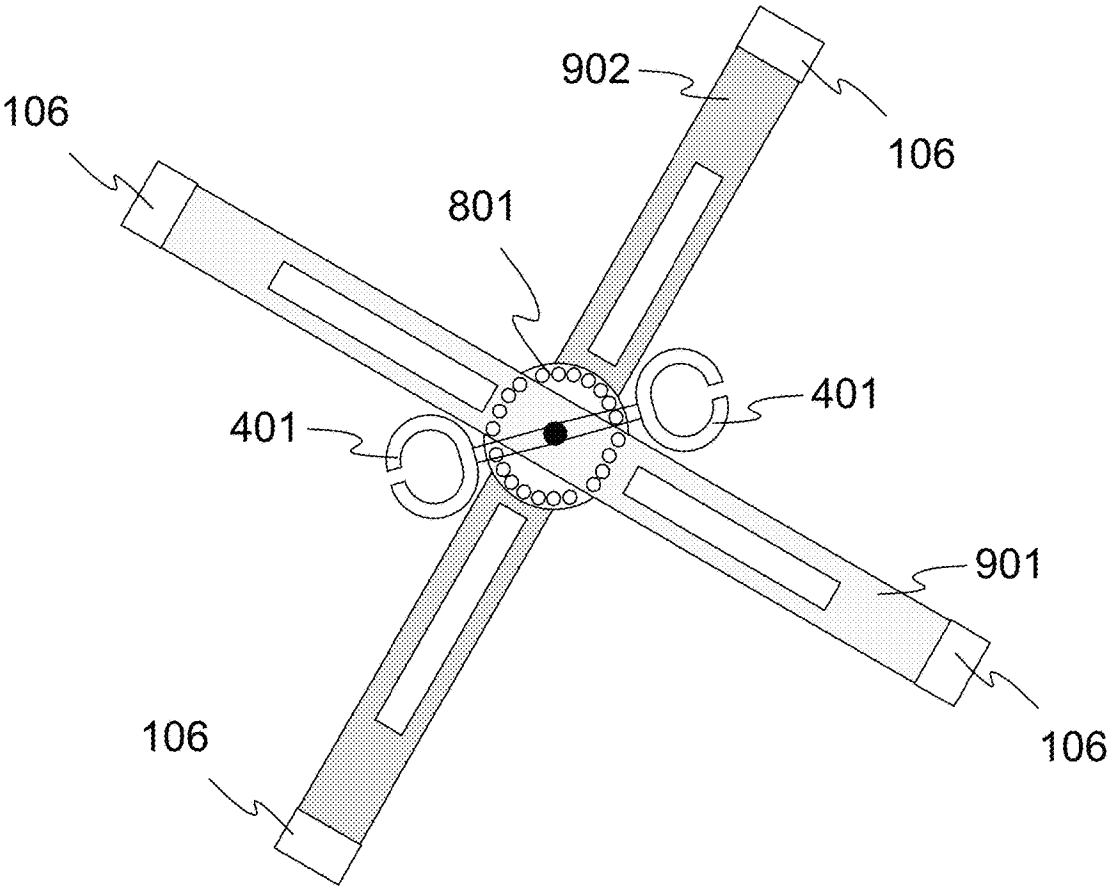
FIG. 9 is a top view of one instance of a pin hole disk cross-member 901 engaged on top of another instance of a pin hole disk cross-member 902 at the center pivot 103.
Figure 10A:
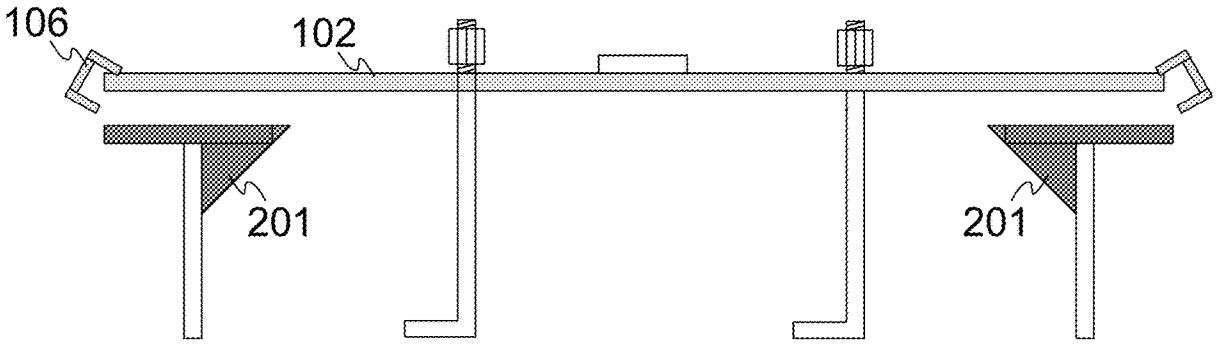
FIG. 10A is a side view of an embodiment of the Concrete Form showing the arrangement of the Concrete Form on a concrete tube form with a blunt chamfer 201.
Figure 10B:
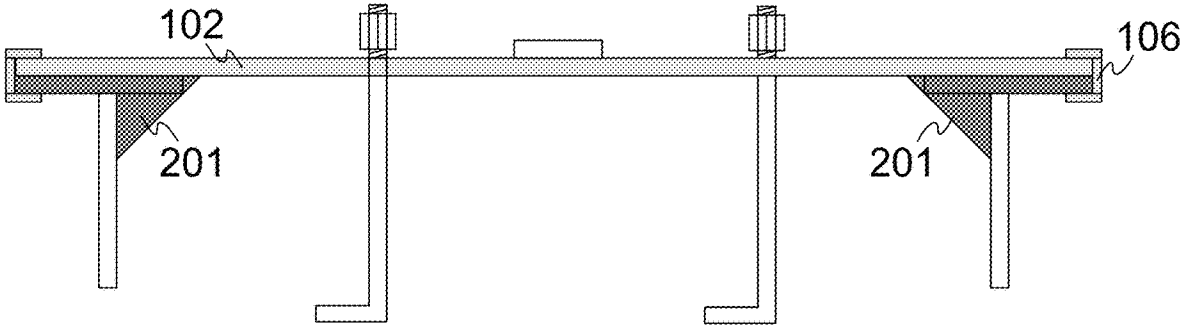
FIG. 10B is a side view of an embodiment of the Concrete Form showing the arrangement of the Concrete Form on a concrete form with the Concrete Form engaged with the concrete tube form with a blunt chamfer 201.
Figure 11A:
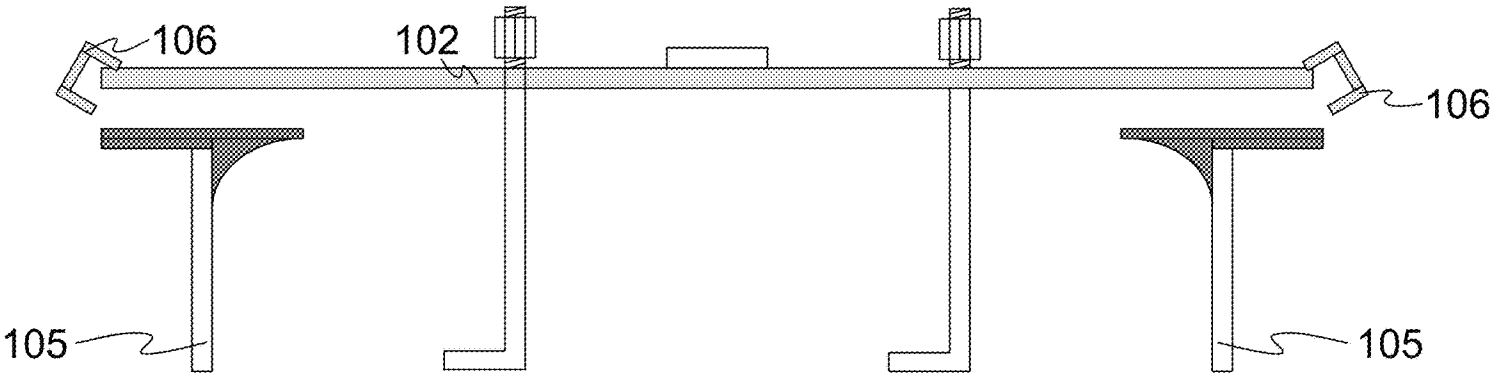
FIG. 11A is a side view of another embodiment of the Concrete Form showing the arrangement of the Concrete Form on a concrete tube form with a curved chamfer 1101.
Figure 11B:
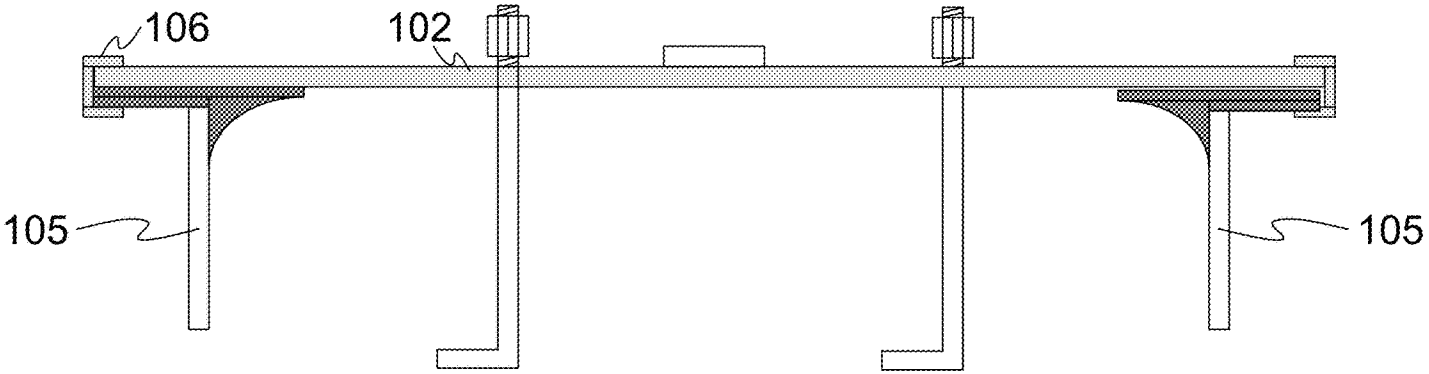
FIG. 11B is a side view of another embodiment of the Concrete Form showing the arrangement of the Concrete Form on a concrete form with the Concrete Form engaged with the concrete tube form with a curved chamfer 1101.
Figure 12A:
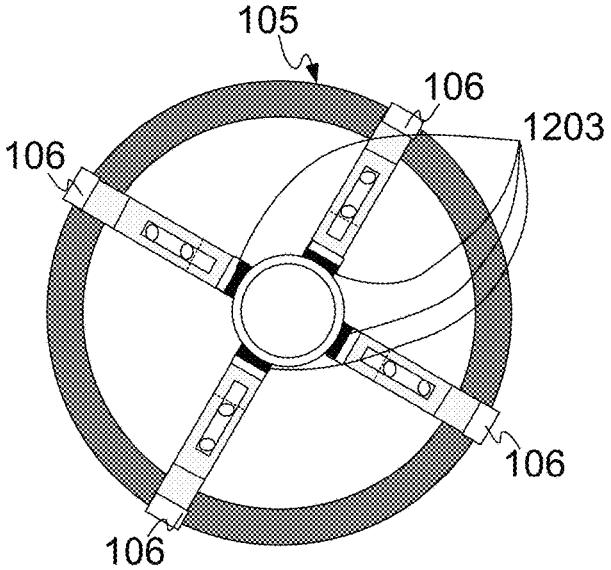
FIG. 12A is a top view of another embodiment of the Concrete Form showing slide arms arranged to support a center object.
Figure 12B:
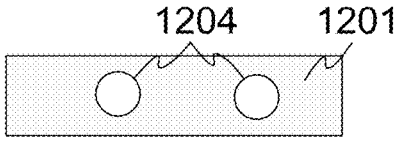
FIG. 12B is a bottom view of an embodiment of a bottom slide arm of the Concrete Form.
Figure 12C:
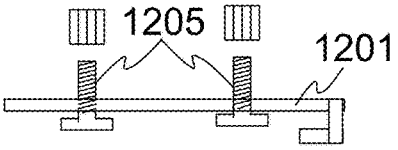
FIG. 12C is a side view of an embodiment of a bottom slide arm of the Concrete Form.
Figure 12D:
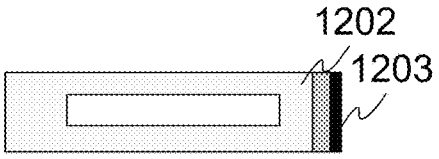
FIG. 12D is a top view of an embodiment of a top slide arm of the Concrete Form.
Figure 12E:
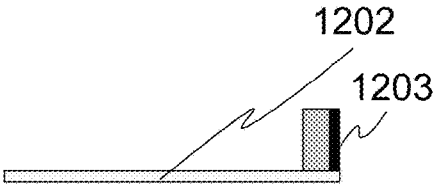
FIG. 12E is a side view of an embodiment of a top slide arm of the Concrete Form.

The cross-members 102 are comprised of a cross-member end 601. The cross-member end 106 serves as a support for the cross-member when placed on top of the form tube 105. The cross-member end 106 is used in conjunction with the end clamp 106, the chamfer disk 101, and a cross-member 102 to secure the cross-member to the form tube. The chamfer disk 101 is first placed atop of the form tube 105. Then the cross-member is engaged to the chamfer disk with the cross-member edge. See FIG. 6B. Lastly the cross-member is affixed to the chamfer disk 101 with the end clamp 106. See FIGS. 7A and 7B.

Each cross-member 102 form one or more bolt guides 104 that serve to maintain the position of anchor bolts as the concrete is cured. The bolt guides 104 are formed by the cross-member 102 with two bolt slots/guides per arm. This will give a total of four locations that anchor bolts can be installed. The anchor bolts 202 or other anchors to be set in the concrete are placed in the bolt guides 104 and then the concrete is poured into the form. Once the concrete cures, the Concrete Form 100 is removed leaving the bolts positioned correctly for the installation of the object to be mounted.

The conduit clamp 401 is an optional device that can be installed through the center pivot aperture 103 with a fastener. The conduit clamp 401 can be used to hold any conduit, tube or any other item 501 during the pour. The conduit clamp 401 can be used to position and secure conduits, rebar, bolts, or any other object that needs to be placed in the hardening concrete. The user secures the object to be positioned with the conduit clamp 401 and allows the concrete to harden thereby affixing the object in the concrete.

An overlay template can also be affixed to the center pivot aperture 103. The template can then be used to position conduits, rebar, bolts, or any other object that needs to be placed in the hardening concrete at a specific location. By way of an example, a bolt that is used to secure a light fixture or pole must be placed over bolts embedded in the concrete.

In another embodiment, the cross-member and a pin hole disk 801 will allow the top and bottom cross-members 102 to be locked at a certain position prior to installation on top of the chamfer ring. This will provide the option of pouring the cement over the top of the cross-members 102 to set the anchor pattern. Alternatively, the user can install the chamfer ring, pour the cement, and then push the anchor bolts down into the concrete while maintaining the correct anchor pattern. Once the anchor bolts are pushed into the concert, the arms will still lock down to the chamfer ring to keep them aligned in the concrete form.

In another embodiment, both ends of the cross-members are clamped with removable end clamps 106. In yet another embodiment, the bottom slide arms 1201 are secured by a fixed clamp 1301. In embodiments with a fixed clamp 1301, the fixed clamps 1301 are permanently affixed to the end of the bottom slide arms 1201. Fixed clamps 1301 will give the contractor more flexibility in securing a slide arm to the chamfer ring when installing an object into the center of a concrete form.

Many concrete installations require a pipe, conduit, or metal framing system, such a slotted channel framing system, to be installed into the center of the form. In another embodiment, the Concrete Form 100 is comprised of top slide arms 1202 and bottom slide arms 1201 that permit supporting any object in the middle of the concrete as it cures. Solid cross-members would not allow this because they occupy the center of the form with no apeature or support for an object. This embodiment will allow the following: 1) Setting of the concrete tube form; 2) installation of rebar; 3) placement of the chamfer ring on top of the form; and 4) pouring the concrete into the tube to the top of the chamfer ring. In order to insure that the pipe or metal framing system holds steady in the center of the form until it cures, top slide arms 1202 and bottom slide arms 1201 are employed. Once the pipe of metal framing system is inserted into the concrete, the slide arms 1201 and 1202 can be adjusted first to engage with the chamfer disk and then extend horizontally to support the vertical object. By placing two or more slide arms to the vertical object, the vertical object will remain upright and centered during the curing process.

The bottom slide arms 1201 are comprised of a fixed clamp 1301 that is placed over the edge of the chamfer ring. The bottom slide arms 1201 form two bolt holes 1204 that will allow for bolts 1205 to affix a bottom slide arms 1201 to the top slide arms 1202. See FIG. 13. Note the threaded portion of the bolt is facing upward. Also, the bolt holes on the bottom slide arm can be round or square. A square hole will engage with certain machine bolts, such as carriage bolts or round head square neck bolts, to prevent the bolt from turning when you tightening a nut or wingnut from the top side. In another embodiment, the chamfer is a rounded edge 1101. This will allow the contractor to match his particular style of finish edge.

Figure 13A:
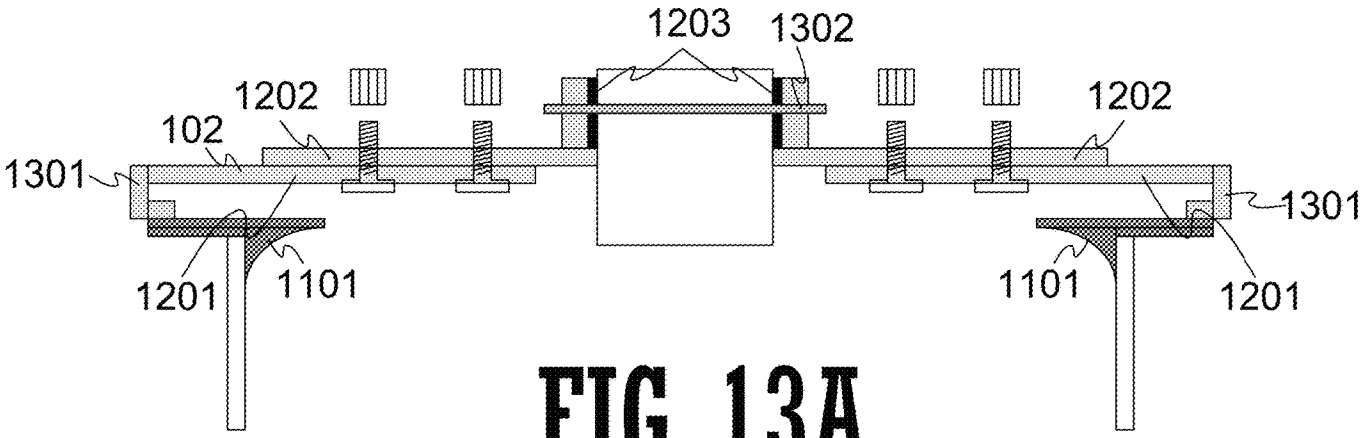
FIG. 13A is a side view of another embodiment the Concrete Form showing the assembly of the Concrete Form on a concrete tube form.
Figure 13B:
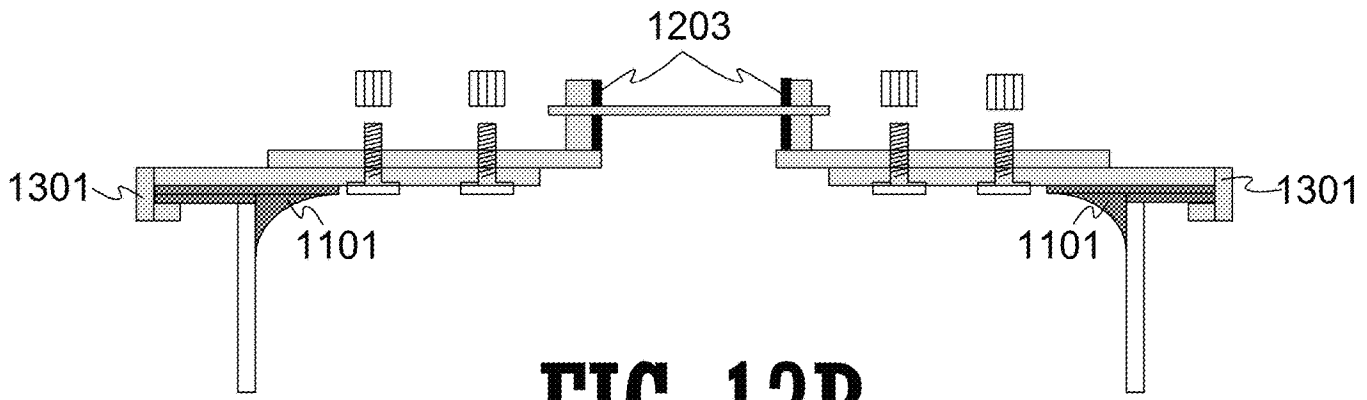
FIG. 13B is a side view of another embodiment the Concrete Form showing the assembly of the Concrete Form on a concrete tube form after the supports are installed.

In another embodiment of the Concrete Form 100 is comprised of a form tube 105, chamfer disk 101, one or more end clamps 106, four or more bottom slide arms 1201, and four or more top slide arms 1202. The bottom slide arms 1201. A top slide arms 1202 forms a slot to be used as an adjustment to work with whatever object the contractor inserts into the middle of the concrete form. A metal framing system is smaller and will required the slides arms to extend closer to the center of the form. A piece of pipe will require the slide arms to be further back. The top slide arm 1202 will have a magnet 1203 that will allow a contractor to place each slide arm member (top 1202 and bottom 1201) in place and not worry about it falling off of the chamfer disk or concrete form. Once all of the necessary top 1202 and bottom slide arms 1201 are in place, a circular clamp 1302 such as a zip tie or metal clamp is used to cinch the sliding arms to the center object. FIGS. 13A and 13B show the additional clamp going over the top, vertical, magnetic piece.

I claim:

1. A concrete form comprised of a form tube, a chamfer disk comprising a ring-shaped disk comprising a chamfer that is either blunt or curved and is formed in positive relief under the ring of the chamfer disk, one or more form cross-members manufactured from metal, metal alloy, or a polymeric material where the one or more form cross-members include a top and bottom cross-members, each cross-member forms one or more bolt guides that serve to maintain the position of anchor bolts as concrete is cured; wherein the bolt guides are formed by the cross-member with two bolt slots or guides per arm, an optional conduit clamp wherein the conduit clamp is secured to one or more cross-members via a center pivot pin that passes through a center pivot aperture, each cross-member will have a center disk that will allow top and bottom cross-members to be locked together with the use of a bolt, pin, grove or fasteners through a center pivot point, each cross-member will have a form, one or more bolt guides that serve to maintain the position of anchor bolts as the concrete cures, and a disk that will allow the cross-members to be locked into place, one or more slide arms manufactured from metal, metal alloy, or polymeric material and are comprised of a bottom slide section, a top slide section, magnetic ends, and held together by holes and bolts, the one or more slide arms can be used along with a circular clamp to center pipe, or steel, in a center of a support;

wherein the form cross-members are comprised of a center pivot, two bolt guides which are formed by the cross-members with or without pin hole disk, and one or more slide arm guides comprised of bottom slide arms that form two bolt holes, top slide arms, a magnet, and bolts that are held together by the circular clamp;

wherein the chamfer disk is a disk that sits atop of the form tube where the chamfer disk forms side chamfers that when placed upon the form tube causes chamfers or to be formed in the concrete when it is poured;

wherein the form cross-members are manufactured from steel and are approximately ¼ inch in thickness and approximately two inches wide.

2. The concrete form described in claim 1 wherein the form cross-members can be thicker towards the end of the cross-members, the ends that rest on the circumference of the form, relative to the middle of the cross-members to provide the necessary support for the concrete form when in practice.

3. The concrete form described in claim 1 wherein the chamfer disk is a separate formed or molded piece that sits on top of the tube form in order to form a chamfer in the concrete.

4. The concrete form described in claim 1 wherein the optional conduit clamp holds any conduit or tube during the concrete pour.

5. The concrete form described in claim 1 wherein the bolt guides have two cross-members with two bolt slots/guides per arm.

6. The concrete form described in claim 1 wherein the form cross-members are comprised of a cross-member edge wherein the cross-member edge serves as a support for the cross-member when placed on top of the form tube; and wherein the cross-member edge is used in conjunction with the cross-member clamp, the chamfer disk, and a cross-member to secure the cross-member to the form tube.

7. The concrete form described in claim 1 wherein an overlay template can also be affixed to the center pivot wherein the template can then be used to position conduits, rebar or bolts that need to be placed in the hardening concrete at a specific location.

* * * * *